US006134820A

United States Patent [19]

Martinez

[11] Patent Number: 6,134,820

[45] Date of Patent: Oct. 24, 2000

[54] HAND-HELD SAFETY SIGNAL

[76] Inventor: Robert L. Martinez, P.O. Box 450454, Grove, Okla. 74345-0454

[21] Appl. No.: 09/277,089

[22] Filed: Mar. 26, 1999

[51] Int. Cl.[7] ..... G09F 21/02

[52] U.S. Cl. ..... 40/586; 116/63 P; 340/321

[58] Field of Search ..... 40/582, 586, 607, 40/612; 116/63 P; 340/321

[56] References Cited

U.S. PATENT DOCUMENTS

| | | | |
|---|---|---|---|
| D. 351,807 | 10/1994 | Smith et al. . | |
| 1,263,072 | 4/1918 | Klink . | |
| 1,719,602 | 7/1929 | Eskilson | 40/582 |
| 2,409,957 | 10/1946 | Reynolds . | |
| 3,075,174 | 1/1963 | Orszulak | 40/586 |
| 3,810,091 | 5/1974 | Hoover . | |
| 3,970,033 | 7/1976 | Lindner et al. | 40/582 |
| 4,042,919 | 8/1977 | Patty . | |
| 4,235,033 | 11/1980 | Eilers . | |
| 5,023,607 | 6/1991 | Staten . | |
| 5,195,264 | 3/1993 | Johanson et al. . | |
| 5,276,424 | 1/1994 | Hegemann . | |
| 5,493,292 | 2/1996 | Fanslow et al. . | |
| 5,687,500 | 11/1997 | Lamparter | 40/572 |
| 5,694,110 | 12/1997 | Clifford . | |
| 5,755,051 | 5/1998 | Zumbuhl . | |

*Primary Examiner*—Cassandra H. Davis
*Attorney, Agent, or Firm*—John D. Gassett

[57] ABSTRACT

A hand-held wafer-like signal which is essentially flat octagonally shaped with a handle at the lower end. It has a front side and a back side. The front side is a unitary construction made by plastic injection molding and has a reflector surface, one-half of a handle and a one-half of a cylindrical light housing which is essentially perpendicular to the reflective surface. There is a back side which is also made by injection molding and also has a reflective surface inside an octagonal frame, one-half of a battery container and one-half a cylindrical light housing. The one-half front and back sides are secured together as by screwing and when assembled it becomes a lightweight weatherproof hand-held signal.

11 Claims, 3 Drawing Sheets

HAND-HELD SAFETY SIGNAL

BACKGROUND OF THE INVENTION

This invention relates to hand-held signals such as used by school guards and road construction personnel. It relates especially a lightweight, easily constructed, signal.

Hand-held traffic control signals are well known. A large number of these consists of an octagonal frame with a handle extending out at the lower side. That type signal has a face which is usually red with "STOP" in bold letters across the face. For some uses, one side may be amber with the letters "SLOW" on that face. These have served a useful purpose in the past and have been widely used. However, some of these are not as easily seen in inclimate weather or in the darkness as desired. Various lighted sign structures have been suggested and many have been patented. These tend to be heavier than the aforementioned hand-held signals and over a period of time tires the worker too severely. Many of these illuminated hand-held signals are heavier than desired and do not make use of reflective material as may be desired.

SUMMARY OF THE INVENTION

This invention concerns a hand-held signal which is relatively lightweight and which attracts attention during inclimate conditions. It includes a front unitary side and a back unitary side. In a preferred embodiment the two sides are nearly symmetrical. The first or front side is basically of an octagonal shaped edge with a half battery housing at the lower part of the edge. The area (or face) inside the edge is of a reflective material. The half battery housing, the edge, the reflective face and the light casing are of unitary construction. A mold is used to construct this of polyethylene. The top edge of the side of the octagonal edge where the half battery casing is, is half a light cylinder which is perpendicular to the face and made integral therewith.

The back side or half of the signal likewise has an edge and a reflective surface in between there, a half battery housing and a half light cylinder.

When the front side and the back side are placed together the two one-half battery housing at the lower end fit together to form a complete battery housing and a convenient handle for the signal. The top of the hand-held signal has a two half light cylinders which align to form a complete light cylinder. A light bulb is provided inside the complete light cylinder. Lenses are provided at each end of the completed signal.

The lower end of each half of the one-half battery housing is provided with threads so that when they are fit together they form a completed fitted surface for a cap to screw on which holds the batteries firmly in the completed handle or battery housing which are the same.

It is desired to put a command or signal in letter form on both the front and back reflector surfaces or faces. Each face has indentations in the form of a word such as "STOP" or "SLOW." Reflective tape of a desired color is placed in these indentations. In the preferred embodiment, each reflective surface is concave to improve the reflectivity.

Means are provided to secure the entire front side to the entire back side and in this event there will be a hollow space between the front and rear reflector. It is through this space that the electrical wiring from the batteries to the light is run. Proper switching including flashing switches are provided.

It is an object of this invention to obtain a reasonably lightweight hand-held signal which makes use of excellent reflective materials.

It is another object to have a unitary front side and a unitary back side which fit together to form the main structure of a hand-held signal.

Various further objects will become apparent by reason of the detailed description taken in conjunction with the drawings.

BRIEF DESCRIPTION OF THE DRAWINGS

Other objects and advantages of the invention will become apparent upon reading the following detailed description and upon reference to the drawings in which.

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION

Figure 1:
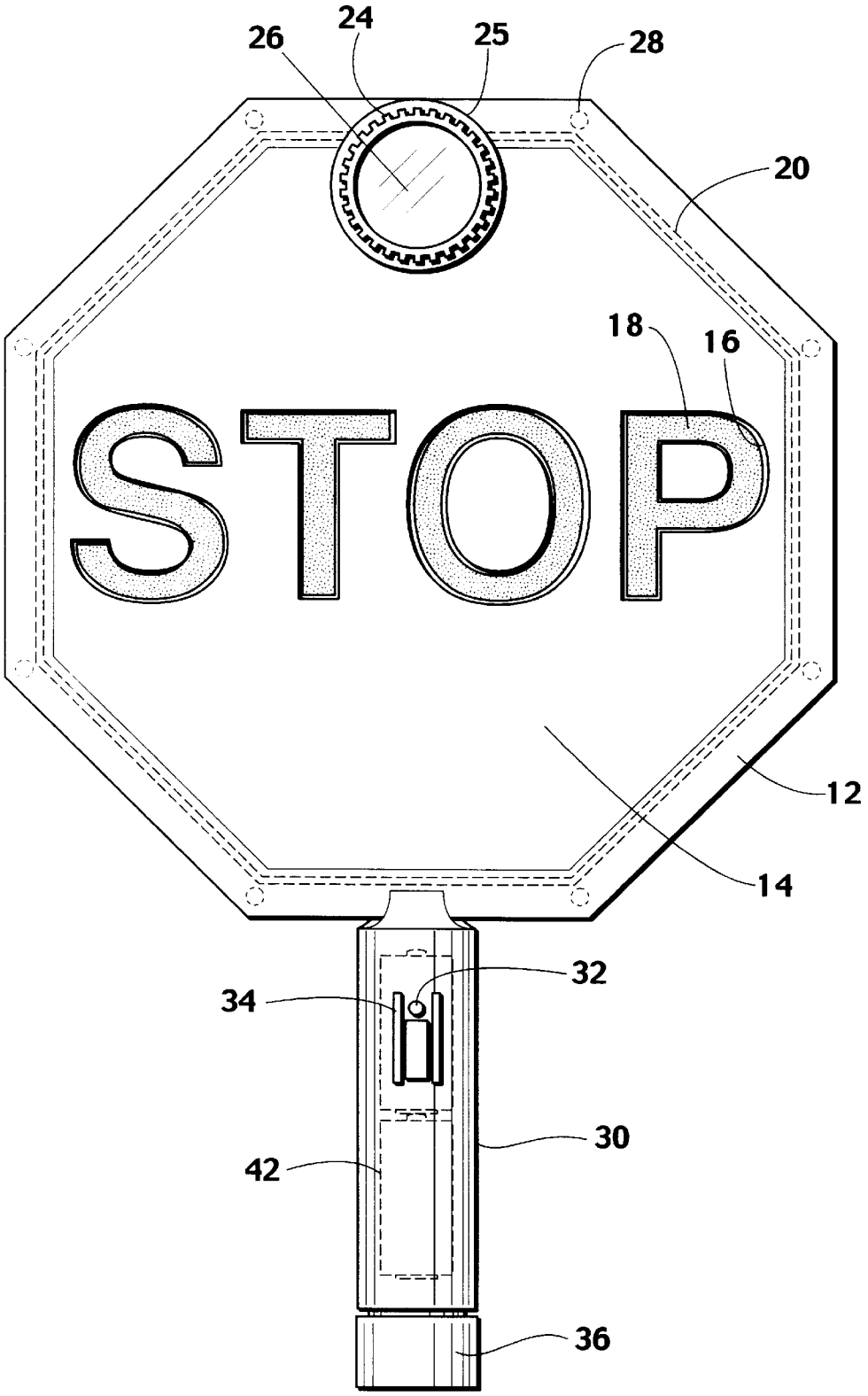
FIG. 1 is a view of the front side of my hand-held signal.

Attention is first directed to FIG. 1 which illustrates a front view of the front side of a signal 10. It includes an edge 12 which in this case is octagonal which is a normal configuration for a hand-held signal. Inside the edge 12 is a face or reflector 14. Across the middle of the front is a designation "STOP" which is formed by the indentation 16 within the reflector 14. Within the indentation is reflective material tape 18 which would normally be white. The reflector 14 would normally be red because that is a uniform color for a stop signal. Also shown are a plurality of screws 28 which can be seen in FIG. 4 as a means for holding the front side and the back side together. At the bottom of the octagonal edge there is a battery housing 30 which includes a switch 34 with a flasher switch 32. At the top of the edge is a light 22. The light 22 has a lens 26 and a lens cover 24. An O-ring groove 20 is indicated and will be discussed later in connection with FIG. 4.

Figure 2:
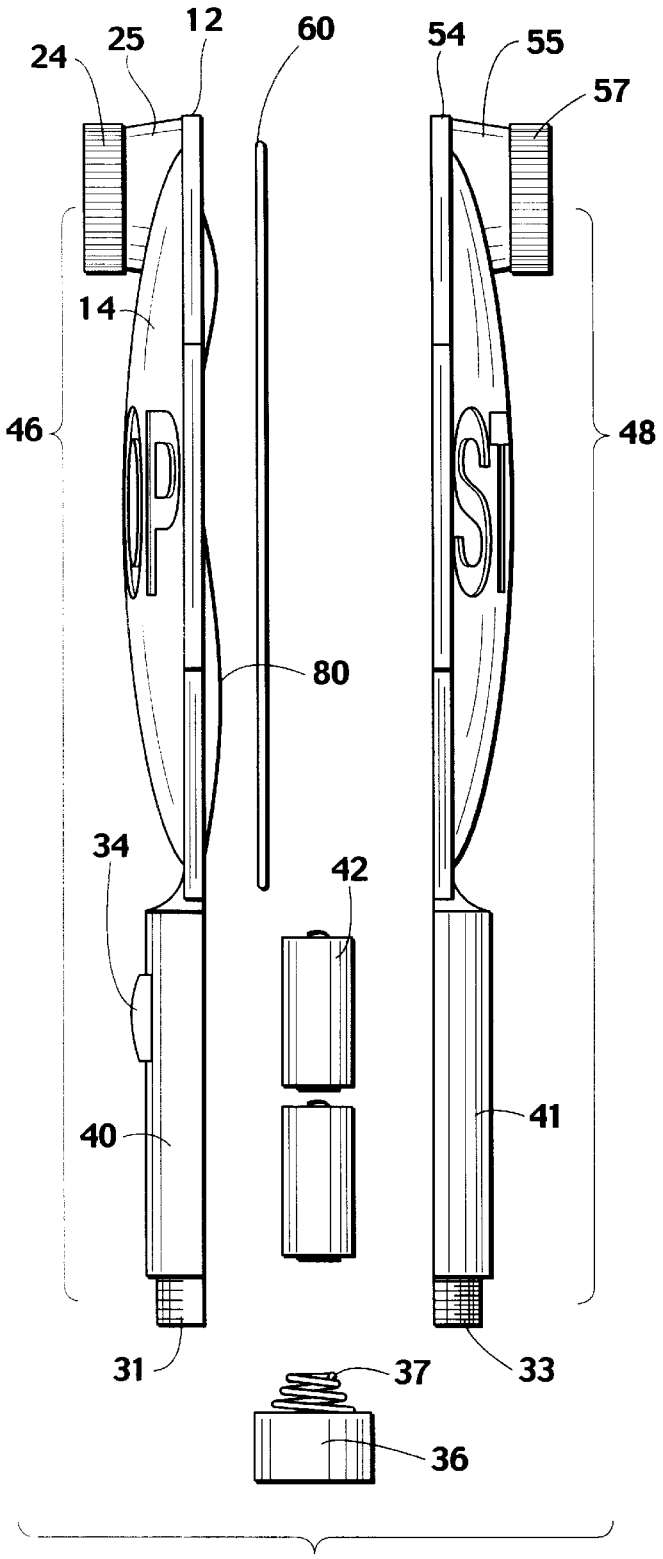
FIG. 2 is a side view of FIG. 1 in exploded form showing the front unitary side of a signal and the back unitary side and with a cap for fitting over the end of the handle.
Figure 3:
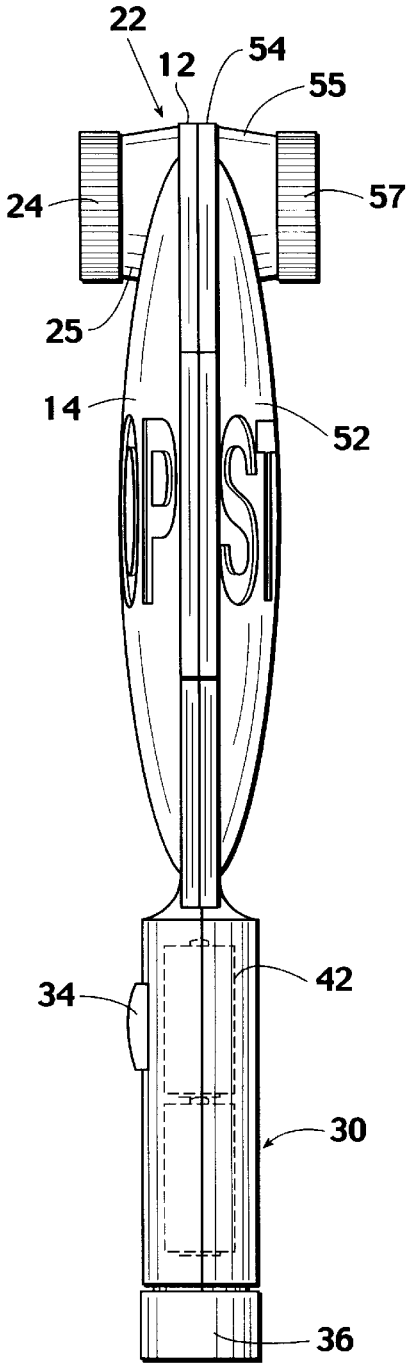
FIG. 3 is a side view of FIG. 2.

Attention is now directed to FIG. 2 which is an exploded view of FIG. 3 which is a side view of FIG. 1. Shown thereon on the left side is the front side view of the device of FIG. 1 and is identified broadly as 46 and on the right side broadly identified as 48 is the back half. The numerals displayed on FIG. 1 are also shown on the front side 46 in FIG. 2 and like numbers signify the like element or feature thereof.

Figure 4:
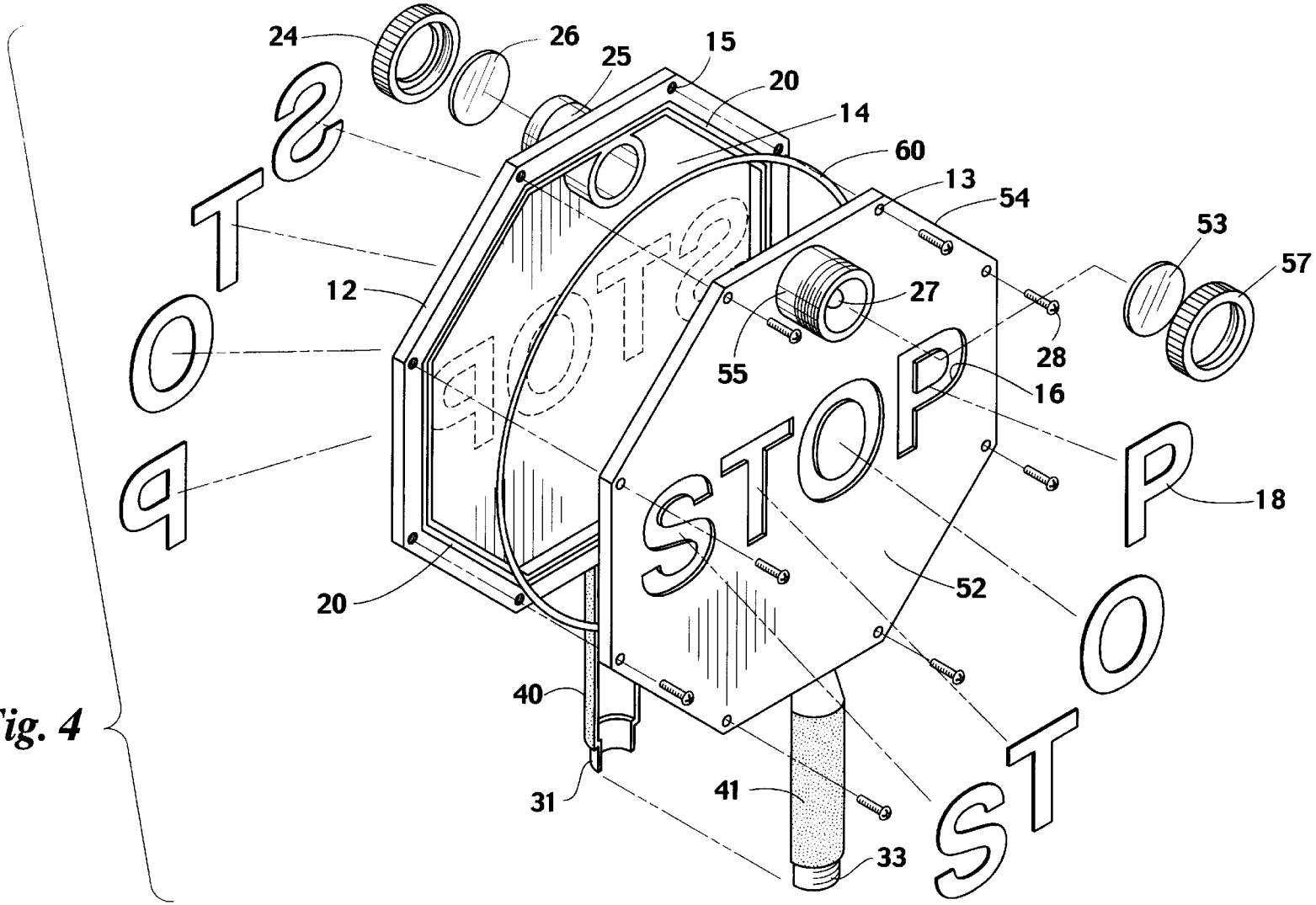
FIG. 4 is an isometric view of the hand-held signal in exploded view showing the manner of assembly.

The right side or back side is illustrated by bracket 48 and is identical in construction to the front side 46 except for the battery housing switch 44 and O-ring groove 60 (See FIG. 4). The front and the back sides are each unitary. They are preferably made by injection molding using polypropylene. In the case shown, the word STOP is displayed on both the front side 46 and the back side 48. When in this case the reflector is red and the letters of the words would normally be white. However, it is anticipated that frequently it will be desired to have the word SLOW on the back side instead of the word STOP. When the word SLOW is used, typically the reflector will be amber and the letters themselves will be blue. It is of course readily understood that about any combination can be used. However, these just mentioned are typically the traditional and accepted colors.

Typically, in a preferred embodiment, the reflector 14 is about 12¼ inches across and the apex of the concave surface is about 3/16 inch from the plane defined by the contact line where the reflector engages the edge 12. Likewise, these dimensions will preferably be the same on the back side the reflector 52 and an edge 54 which correspond to reflector 14 and edge 12 of the front side of the signal. Back half 48 of FIG. 2 has a cylindrical housing 55 which when put together with the front and back side and assembled as shown in FIG. 3, they form a light housing 22 which has a bulb 27 and lens 26 and 53 with retainers 24 and 57 such as is more clearly seen in FIG. 4. Reflector 52 is similar to reflector 14 with the exception that when the signal was used for certain type signaling the back side 52 is of a different color from reflector 14. As mentioned above, frequently the reflector 14 will be red with white letters and the reflector 52 will be amber with blue letters. This is used quite frequently in road construction work.

As seen in FIG. 3, when the front side 46 is assembled with the back side 48 there is formed a complete battery housing 30. Then the threads 31 and 33 form a complete thread over which cap 36 may be screwed. Cap 36 has contact springs 37 as in normal flashlight construction. Also shown in FIG. 3 is an O-ring 60 which fits into the O-ring groove 20 illustrated in FIG. 1 and more clearly illustrated in FIG. 4.

Attention is next directed to FIG. 4 which is in an expanded isometric view of FIG. 2, less the battery cap and the batteries. Shown thereon are reflector 14 with edge 12 and integral therewith is one-half of a light housing 25 at the top and at the bottom a one-half 40 of a battery and handle. The reflector in this case is red and has white lettering spelling the word "STOP" thereon.

Also shown is the back side 48 which includes reflector 52 with edge 54. Integral therewith is a half 55 of light 22. At the lower side of edge 54 is one half 41 of the battery housing. In the interest of making this waterproof, there is a groove 20 on the inside portion of edge 54 into which O-ring seal 60 is placed.

In assembly, lens retainer 57 and lens 53 are secured to cylinder 55 and lens 26 and lens retainer 24 are screwed onto half light housing 25. An electric wire 80 is run from the power line 80 from the switch to the base of the bulb 27. The ground line (not shown) goes from the plus end on the bulb to the negative side of the battery to the cone of the bulb. Then O-ring 60 is placed into groove 20 and edges 12 and 54 are abutted against each other as shown in FIG. 3 with the seal secured in the groove 20. Half handles 41 and 40 are firmly pressed together and form a handle housing 30 as shown in FIG. 3.

Half light cylinders 55 and 25 are positioned adjacent each other and will stay in that manner to form a light cylinder 22 after the edge 54 is secured to edge 12. A first magnifying red lens 26 is positioned in half cylinder 25 and is held in position by lens retainer 24. Likewise, magnifying lens 53 is held in position by waterproof retainer 57 which is threadedly fitted over half cylinder 55. Lens 53 can be any desired color, however, it will normally be the same color as the color of the reflector 52 which is on the same side. As shown here, both reflectors 14 and 52 are red because they have the word STOP spelled out thereon. However, if reflector 52 has a SLOW sign there and is amber in color with the blue lettering then the magnifying lens 53 would be amber. In assembly, the O-ring 60 would be placed into groove 20 in edge 54 and firmly placed on top of the O-ring 60 would be edge 12. This would be compact as shown in FIG. 3. To hold them in place there are a plurality of holes 13 drilled through the edge 12 and are in line with each of a plurality of holes 15 drilled into edge 54. Self-tapping screws 28 are inserted through holes 13 into hole 15 where they are screwed until they are secured in a normal manner.

After the device is thus assembled, threads 31 and 33 of the one-half battery housings form a complete threaded end of the housing onto which the cap 36 is screwed as shown in FIG. 1 and the device is fully assembled.

To briefly summarize it is seen that I have a novel hand-held signal which has a front unitary side which has a first reflector which is integral to the first edge of a selected configuration which is normally octagonal. There is a second or back unitary side which mates with the front unitary side. Likewise, the back unitary side has a second reflector and a second edge. The front and back side at the bottom of the edge each has a half of a battery housing and each side has a half of a light cylinder housing which is made integral with the edge. The battery casing becomes the handle when the two sides are assembled. The two light half cylinders mate and form a light cylinder sufficient that one bulb can light each end thereof. There is a hollow space between the front side and the back side, thus electrical conduits can go from the battery to the light bulb. In a preferred embodiment, each reflector is concave which provides for the space just mentioned. Typically, the part of the reflectors 14 and 52 exposed after the device is assembled is smooth and the inside is knurled to obtain high reflecting capabilities.

The main components of each half, namely, the edge, the reflector, the half battery casing and half of the cylindrical light housing are molded integrally. This reduces the assembly time and makes it strong and resistant to weather. It is estimated that the weight of one of these preferred assembled signals will be not over about 2¼ pounds. The prior lighting signals may exceed five pounds. Traditionally, weight tires the workers out much quicker.

Thus, it is apparent that there has been provided, in accordance with the invention, a hand-held safety signal that fully satisfies the objects, aims and advantages set forth above. While the invention has been described in conjunction with specific embodiments thereof, it is evident that many alternatives, modifications and variations will be apparent to those skilled in the art and in light of the foregoing description. Accordingly, it is intended to embrace all such alternatives, modifications and variations as fall within the spirit of the appended claims.

What is claimed is:

1. A hand-held signal comprising:

a first unitary side having a first edge of a selected configuration, a first reflector within said edge and integral therewith, a first one-half battery housing at a first location on said first edge and integral therewith, a first portion of a signal light in the form of a cylinder and integral with said first edge;

a second unitary side having a shape similar to said selected configuration of said first side and having a second edge and a second reflector within said second edge and being unitary therewith;

a second one-half battery housing unitary with said second edge;

when said first side and second side are placed together said first one-half battery housing and said second battery housing are matched to form a complete battery housing having a lower end and said first and second one-half light housing form a complete light housing;

a cap for closing the lower end of said complete battery housing;

means to hold said first side to said second side.

2. A signal as defined in claim 1 including:

an O-ring; and an O-ring groove along an edge to receive said O-ring.

3. A signal as defined in claim 2 in which each reflector has an inside and an outside and is smooth on the outside but knurled on the inside.

4. A signal as defined in claim 3 in which the first reflector is of a different color than that of the second reflector.

5. A signal as defined in claim 3 wherein the outside of each reflector is convex.

6. A signal as defined in claim 1 in which the means to hold the sides together include a plurality of holes around the edge of said first side and a plurality of matching holes along the edge of said second side;

self-tapping screws extending through said first hole and into said second hole for each such mating set of holes;

a series of indentations on each first and said second side in the form of a selected word;

a reflective tape of about the same size as said indentation and being placed therein.

7. A hand-held signal comprising:

a first unitary side having an octagonal shaped edge, a reflector within said edge and integral therewith and having an outer side and an inner side, a one-half battery housing at a first side of said edge and integral therewith, a first side of a signal light in the form of a cylinder integral with said edge;

a second unitary side having an octagonal shape having a second edge and of being essentially the same configuration as said first unitary side, including a reflector within said second edge and being unitary therewith, said reflector of said second unitary side having an outer side and an inner side, a second one-half battery housing unitary with said second edge, a second side of a signal light in the form of a cylinder and an O-ring groove along the edge of said second edge;

when said first side and second side are placed together said first one-half battery housing and said second one-half battery housing are matched to form a full and complete battery housing having a lower end and said first and second side of a light housing form a complete light housing;

a cap for closing the lower end of said complete battery housing;

an O-ring;

means to hold said first side to said second side.

8. A signal as defined in claim 7 in which the means to hold the first side to said second side include a plurality of holes around the edge of said first side and a plurality of matching holes along the edge of said second side;

self-tapping screws extending through said first hole and into said second hole for each such mating set of holes;

a series of indentations on the outer side of each reflector of each first and said second side in the form of a selected word;

a reflective tape of about the same size as said indentation and being placed therein.

9. A signal as defined in claim 8 in which each reflector is smooth on the outer side but knurled on the inner side.

10. A signal as defined in claim 9 in which the first reflector is of a different color from the second reflector.

11. A hand-held signal comprising:

A. a first unitary side having a
   a) first edge of a first selected configuration
   b) a first reflector integral with said first edge, said reflector having a smooth side and knurled side;
   c) one-half of a cylindrical housing integral with said edge;

B. a second unitary side having
   a) a second edge of a second selected configuration similar to said first selected configuration;

C. a second reflector integral with said second edge, said second reflector having a second smooth side and a second knurled side;
   c) a communication on at least one of said smooth sides;
   d) a second one-half of a cylindrical housing integral with said second edge;

D. means to hold said first and said second side together such that said first and second half-cylindrical housing to form a battery housing and a handle.

* * * * *